US011497261B2

(12) United States Patent
Cuoco

(10) Patent No.: US 11,497,261 B2
(45) Date of Patent: Nov. 15, 2022

(54) DUST HOOD

(71) Applicant: SteelGorillas LLC, South Pasadena, CA (US)

(72) Inventor: Candice Cuoco, South Pasadena, CA (US)

(73) Assignee: STEELGORILLAS LLC, South Pasadena, CA (US)

( * ) Notice: Subject to any disclaimer, the term of this patent is extended or adjusted under 35 U.S.C. 154(b) by 332 days.

(21) Appl. No.: 16/812,663

(22) Filed: Mar. 9, 2020

(65) Prior Publication Data

US 2020/0281286 A1 Sep. 10, 2020

Related U.S. Application Data

(60) Provisional application No. 62/815,481, filed on Mar. 8, 2019.

(51) Int. Cl.
*A41D 13/11* (2006.01)
*A62B 23/02* (2006.01)
*A42B 3/28* (2006.01)

(52) U.S. Cl.
CPC ..... *A41D 13/1153* (2013.01); *A41D 13/1184* (2013.01); *A62B 23/025* (2013.01)

(58) Field of Classification Search
CPC ..... A41D 13/1153; A41D 13/1184; A62B 23/025; A62B 17/04; A42B 1/046
See application file for complete search history.

(56) References Cited

U.S. PATENT DOCUMENTS 979,433 A * 12/1910 Clay ..... F16L 17/067 285/112
2,525,236 A * 10/1950 Palmer ..... A61F 9/068 128/205.25
4,231,359 A * 11/1980 Martin ..... A62B 17/04 128/206.29
4,457,027 A * 7/1984 Gladstone ..... A42B 1/046 2/174
4,961,232 A * 10/1990 Hulsey ..... A41D 13/1153 2/205
4,989,598 A * 2/1991 Berg ..... A62B 18/082 128/206.23
5,040,530 A * 8/1991 Bauer ..... A62B 17/04 D24/110.2
5,140,980 A * 8/1992 Haughey ..... A62B 17/04 D24/110.3
D331,297 S * 11/1992 Herod ..... D29/106
(Continued)

*Primary Examiner* — Robert H Muromoto, Jr.
(74) *Attorney, Agent, or Firm* — Myers Wolin, LLC

(57) ABSTRACT

A dust hood is provided having a front face of an inelastic material and a rear face of the inelastic material. The front face has a first opening configured to correspond to a location of a user's eye protection when worn by the user. The front face also has a primary breathing opening configured to correspond to a respirator hose or respirator air intake location when worn by a user. The dust hood openings each comprise a gasket for sealing the corresponding openings against corresponding accessories. Accordingly, the first opening gasket seals the hood against a user's eye protection and the second opening gasket seals the primary breathing opening against a user's respirator hose or respirator air intake.

20 Claims, 10 Drawing Sheets

(56) References Cited

U.S. PATENT DOCUMENTS 5,186,165 A * 2/1993 Swann ..... A62B 17/04 128/201.28
5,211,668 A * 5/1993 Secord ..... A42B 1/046 2/202
5,214,803 A * 6/1993 Shichman ..... A42B 1/046 2/202
5,575,009 A * 11/1996 Ryvin ..... A41D 13/1161 2/202
5,628,308 A * 5/1997 Harges, Jr. ..... A41D 13/1153 128/206.28
5,690,095 A * 11/1997 Glynn ..... A62B 17/04 128/201.24
5,832,538 A * 11/1998 Williams ..... A42B 1/0187 2/200.1
5,996,580 A * 12/1999 Swann ..... A62B 9/04 128/205.27
6,016,804 A * 1/2000 Gleason ..... A62B 18/10 128/206.16
6,023,787 A * 2/2000 French ..... A42B 1/048 2/202
6,196,223 B1 * 3/2001 Belter ..... A61M 16/0616 128/206.25
6,302,103 B1 * 10/2001 Resnick ..... A62B 9/06 128/206.28
6,338,340 B1 * 1/2002 Finch ..... A62B 18/084 128/206.28
6,374,418 B1 * 4/2002 Rindle ..... A42B 1/048 2/202
6,442,763 B1 * 9/2002 Larson ..... A42B 1/046 2/202
6,460,538 B1 * 10/2002 Kemp ..... A62B 17/04 128/201.29
6,698,427 B1 * 3/2004 Glowers ..... A61M 16/06 128/206.28
6,701,925 B1 * 3/2004 Resnick ..... A62B 17/04 128/205.27
6,758,212 B2 * 7/2004 Swann ..... A62B 17/04 128/206.29
6,761,162 B1 * 7/2004 Swann ..... A62B 17/04 128/205.27
6,817,358 B1 * 11/2004 Resnick ..... A62B 17/001 128/201.25
6,874,499 B2 * 4/2005 Viner ..... A62B 23/02 55/DIG. 35
6,892,725 B2 * 5/2005 Frund ..... A62B 17/001 128/201.25
7,028,687 B1 * 4/2006 Silver ..... A62B 17/04 128/205.23
D636,128 S * 4/2011 Hancock ..... D29/108
8,316,844 B2 * 11/2012 Bludyan ..... A62B 17/04 128/205.27
9,132,299 B2 * 9/2015 Sutton ..... A62B 7/10
10,265,553 B2 * 4/2019 Boss ..... A62B 17/001
10,893,715 B2 * 1/2021 Noll ..... A42B 1/0186
11,027,156 B2 * 6/2021 Chessari ..... A62B 17/04
2003/0135916 A1 * 7/2003 Hexels ..... A62B 17/00 2/457
2004/0216736 A1 * 11/2004 Lee ..... A62B 17/04 128/201.22
2005/0114986 A1 * 6/2005 Hobart ..... A41D 13/1184 2/171.3
2006/0107950 A1 * 5/2006 Hutchinson ..... A61M 16/0688 128/201.22
2007/0277278 A1 * 12/2007 O'Brien ..... B63C 9/087 2/2.17
2011/0297107 A1 * 12/2011 Kostelec ..... A01K 13/006 119/850
2016/0198778 A1 * 7/2016 Hines ..... A41D 27/10 2/269
2017/0164665 A1 * 6/2017 Johnson ..... A41D 27/205
2019/0261718 A1 * 8/2019 O'Connor ..... A41D 3/02
2020/0288848 A1 * 9/2020 Mowla ..... A42B 1/04
2021/0401074 A1 * 12/2021 Kerr ..... A41D 27/201

* cited by examiner

DUST HOOD

CROSS-REFERENCE TO RELATED APPLICATION

This application claims the benefit of U.S. Provisional Application No. 62/815,481, filed on Mar. 8, 2019, the contents of which are incorporated by reference herein.

FIELD OF THE INVENTION

This invention relates to protective hoods for use in dusty and toxic environments.

BACKGROUND

When performing industrial work, such as sandblasting and bridge maintenance, workers are bombarded with debris and contaminants that can harm their visibility and long-term health. Existing protective gear provides little coverage, is cumbersome to get into, and has to be replaced daily or even multiple times per day. It is also not easily usable with the respiration equipment that workers typically wear. It is also oversized and can get in the way, which can be a significant safety hazard for workers high up on a bridge or scaffolding.

Earlier products could not be easily used in combination with standard respirators. Even hoods having a respirator opening could not accommodate multiple cartridges. To the extent that gaskets were used at openings, they were rigid, limiting fit and cracking under normal use.

During use, existing products trap air and inflate, particularly around a user's eyes, reducing visibility and creating safety risks. Further, such hoods, when inflated, would prevent users from looking down and prevented air circulation, which is not suitable in a construction environment.

Existing attempts to adjust fit, by adding gussets, for example, resulted in poor adjustability, and any addition of a flexible or stretchable material resulted in the addition of permeable, typically woven, segments in the hood which allowed debris and contaminants to reach the user's skin. Any elastic segment was stitched on, resulting in less durable connections and allowed exposure to contaminants.

SUMMARY

A dust-free hoodie is utilized with the Air-Fed, Non Air-Fed and Dual Cartridge full-face air respirator systems. This product prevents and shields debris from entering inside the hood while performing work The dust-free hoodie discussed below addresses many problems in existing products. Much of the hood is made of a non-permeable material, such as a non-woven nylon material, that prevents contaminants and particles from getting through the hood to the skin of a user.

It may be quick-drying, washable, and reusable. The fitted design and stretch side gusset panels provide a better fit to improve visibility and wearability. Plastic gaskets fit to the eye mask and respirator worn by workers. The zipper opening allows for a much quicker on-and-off compared to the equipment currently available, as well as easy access to the respirator mask. Excess fabric allows the air from the respirator to circulate and act as a built-in ventilation system. The elastic hem around the bottom provides a secure fit and makes it convertible for dynamic use.

The side panels may be covered with a nonpermeable guard, such as a nylon panel, to prevent debris from entering through the woven fabric. The zipper panel may be construction-grade and is likewise covered with a guard, to prevent contaminants from entering via the zipper tape and teeth. Double top-lock stitching may prevent debris from seeping through seams and thread perforations. Two additional front openings may allow for the attachment of dual respirator cartridges. The gaskets, which may be a flexible plastic, may stretch to allow for a tighter seal and prevent cracking, are larger to allow for circulation and a better fit, and utilize a thicker plastic for durability. The fit of the hood has been redesigned and streamlined to prevent air from being trapped around the eyes, preventing visual obstruction especially when looking down, and improving air circulation. The primary fabric is now water-resistant and the non-woven nylon material is better suited to protect from debris. The elastic around the bottom is now fully encased for durability and better protection from the elements.

Accordingly, in some embodiments, a dust hood is provided having a front face of an inelastic material, a rear face of the inelastic material, and at least one stretch segment connecting the front face to the rear face. The front face has a first opening configured to correspond to a location of a user's eye protection when worn by the user. The front face also has a primary breathing opening configured to correspond to a respirator hose or respirator air intake location when worn by a user.

The dust hood openings each comprise a gasket for sealing the corresponding openings against corresponding accessories. Accordingly, the first opening gasket seals the hood against a user's eye protection and the second opening gasket seals the primary breathing opening against a user's respirator hose or respirator air intake.

The dust hood may further comprise secondary breathing openings configured to correspond to respirator cartridge locations when coupled with a respirator mask having both a hose and respirator cartridges. In such an embodiment, the secondary breathing openings are provided with gaskets for sealing against corresponding accessories.

In some embodiments, the primary breathing opening and the secondary breathing openings may be provided with filtration materials such that the openings filter debris when not in use with cartridges.

The dust hood may further comprise an elastic band at a base of the hood to seal the hood against a user's neck, or a neck of a protective article of clothing worn by the user. Such an elastic band may be encased in an inelastic material, such as the inelastic material forming the rest of the hood, such that the elastic material provides for a fit against a user's neck, but the inelastic material provides an impermeable barrier for protection.

The front face of the hood may be provided with a plurality of darts to improve the fit of the hood, such that the hood has a larger circumference at the location of the primary breathing opening than at a base of the hood.

The stretch segment of the hood between the front face and the rear face may comprise at least one layer of elastic material and a second layer comprising an inelastic material having a lower permeability than the elastic material, and wherein the size of the second layer of the stretch segment is larger than the size of the first layer of the stretch segment in an unstretched state. Accordingly, the elastic layer may allow the hood to stretch and improve a fit against a user, while the second material may provide an impermeable barrier to protect the user.

The dust hood may further comprise a zipper opening in the rear face. Such a zipper opening may comprise a non-locking zipper.

In many embodiments, the dust hood may comprise a front face and rear face formed of an inelastic material having a first opening configured to correspond to a location of a user's eye protection when worn by a user and a primary breathing opening configured to correspond to a respirator hose or a respirator air intake location when worn by a user. In some such embodiments, no stretch panel is provided.

The dust hood may then further comprise an elastic gasket for sealing the primary breathing opening against the user's respirator. The elastic gasket may then have an outer circumference and an inner boundary, where the inner boundary is smaller than a circumference of a respirator hose or respirator air intake to be used with the dust hood. The outer circumference is larger than the circumference of the respirator hose or air intake. Therefore, the gasket must be stretched around the accessory it is to be sealed against, thereby forming a seal.

The dust hood may have secondary breathing openings configured to correspond to respirator cartridge locations. The secondary openings then comprise secondary elastic gaskets for sealing the corresponding openings against a respirator dock location.

DETAILED DESCRIPTION OF THE PREFERRED EMBODIMENTS

Figure 1:
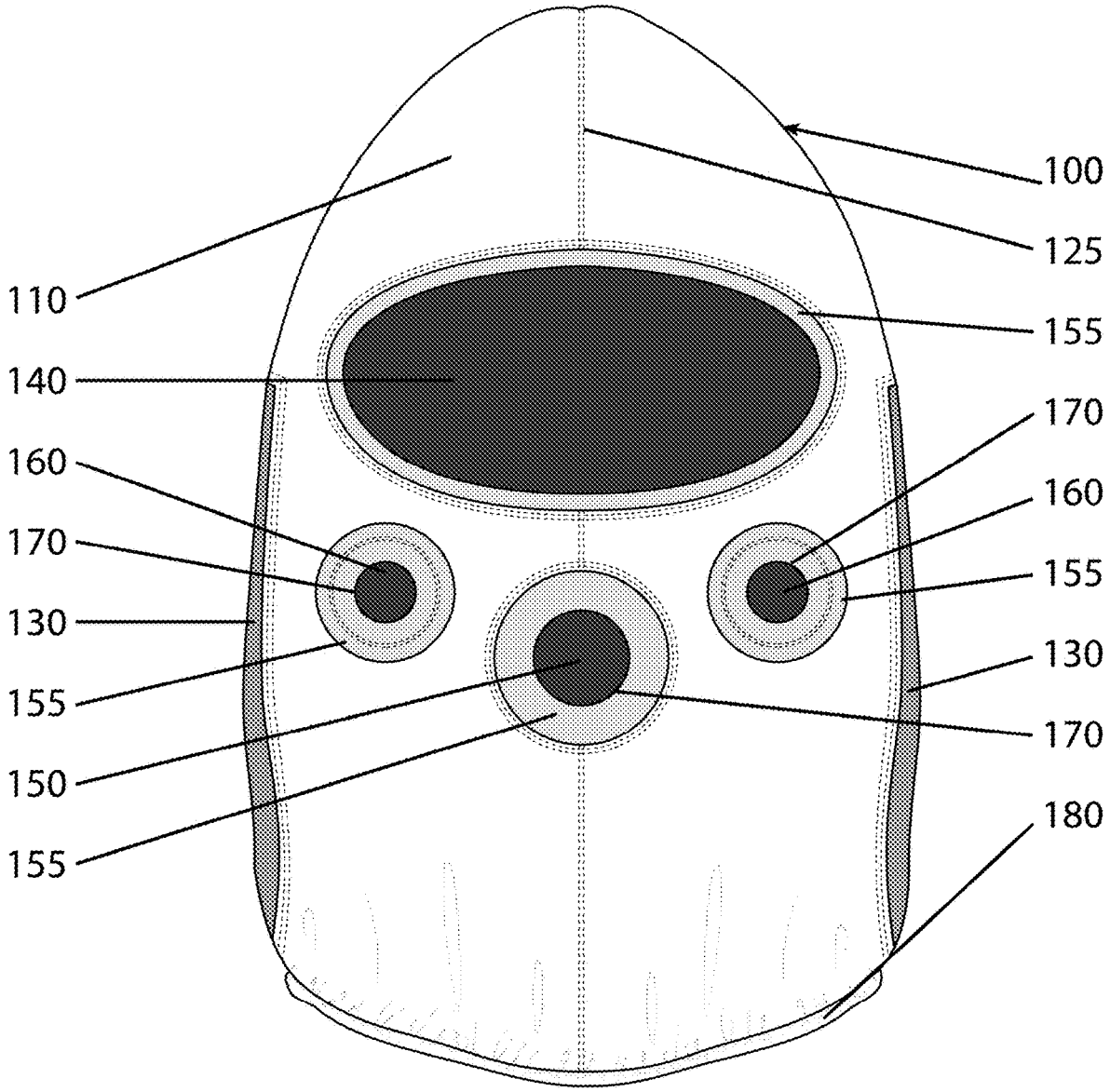
FIG. 1 is a front view of a hood in accordance with this disclosure.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 2:
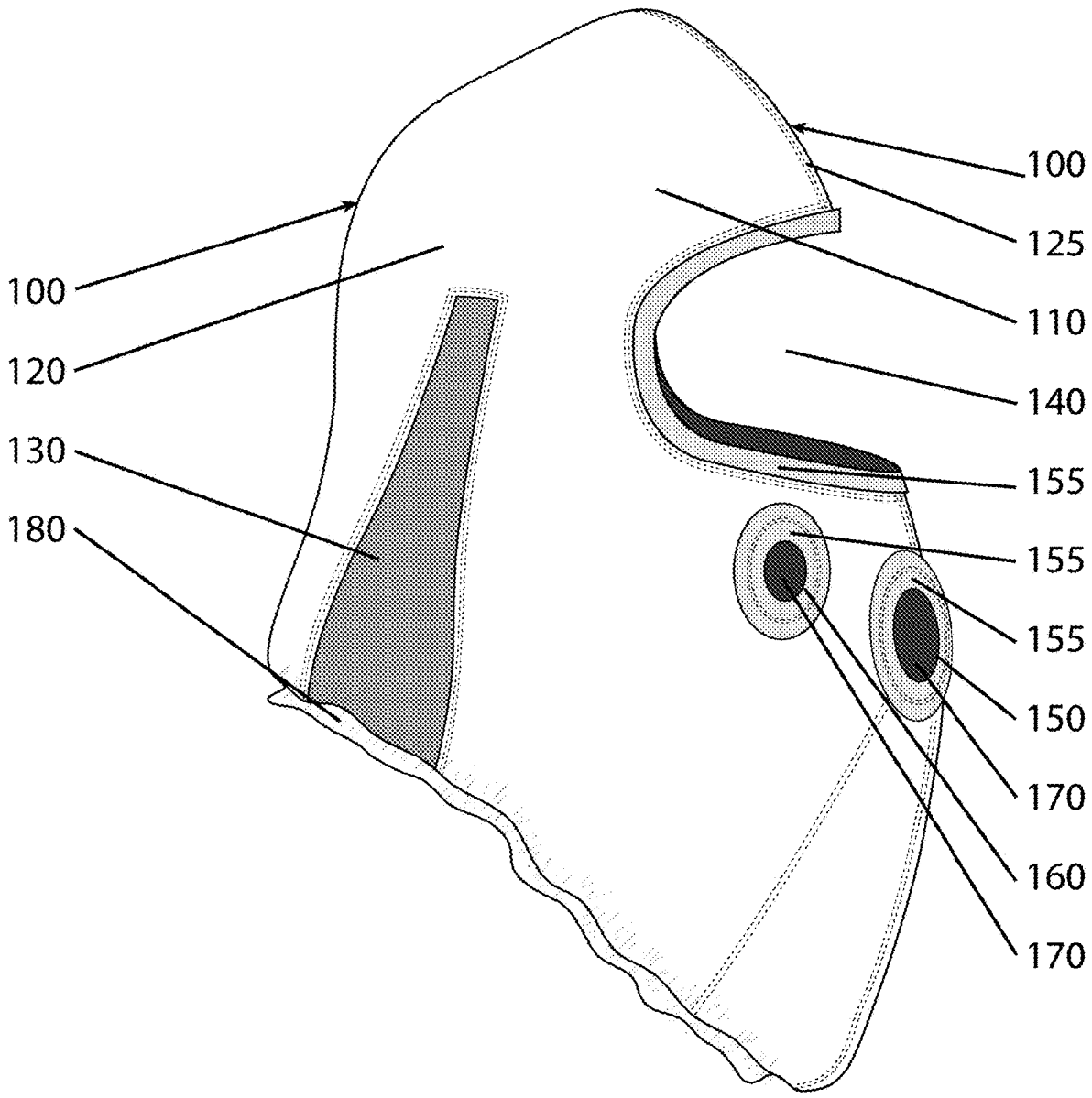
FIG. 2 is a side view of the hood of FIG. 1.
Figure 3:
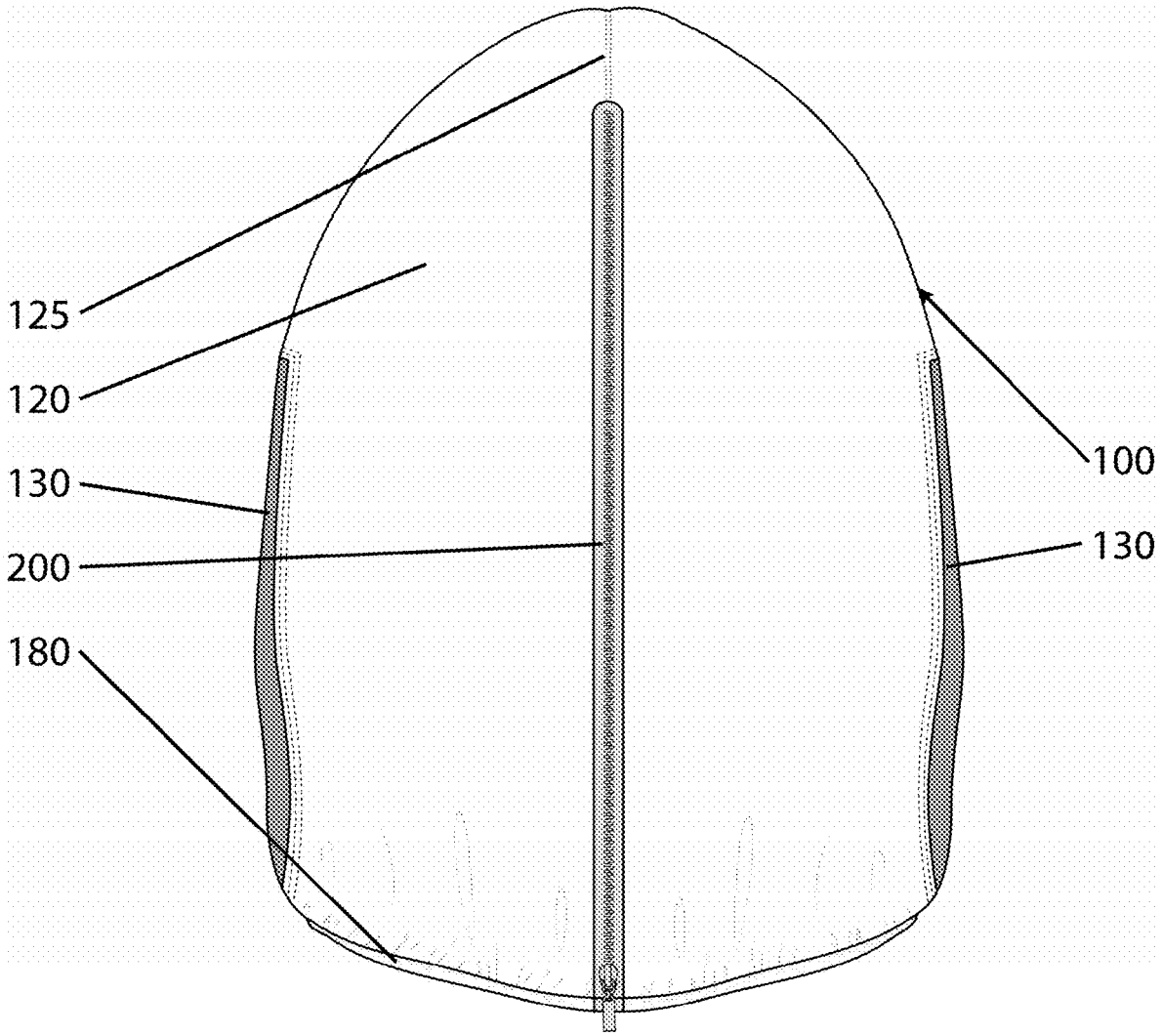
FIG. 3 is a rear view of the hood of FIG. 1.

FIG. 1 is a front view, FIG. 2 is a side view, and FIG. 3 is a rear view of a dust hood 100 in accordance with this disclosure.

As shown, the hood 100 comprises a front face 110 made of an inelastic material, a rear face 120 made of the same inelastic material, and at least one stretch segment 130 connecting the front face 110 and the rear face 120. While the hood 100 is described in terms of a front face 110 and a rear face 120, it will be understood that this is simply a reference to a front portion and a rear portion of the hood. Accordingly, it will be understood that seams 125 of the hood 100 may not distinguish the front and rear faces and may instead run front to back, as in the embodiment shown. Similarly, the front face 110 and the rear face 120 may be formed from a single piece of material or multiple pieces of material folded over a top of a user's head.

The front face 110 has a first opening 140 configured to correspond to a user's eye protection when the hood 100 is worn by a user. The front face 110 also has a primary breathing opening 150 configured to correspond to a respirator hose location when worn by a user.

The hood 100 is often used in conjunction with eye protection and a respirator. Accordingly, when the respirator is worn by a user, the respirator may have a respirator tube, used as a breathing tube, extending away from the user. Such a tube may then pass through the hood 100 at the primary breathing opening 150 of the front face 110.

A respirator worn by the user may further comprise respirator cartridges, typically two such cartridges located on either side of the breathing tube.

The first opening 140 and the primary breathing opening 150 may each be provided with a gasket 155 for sealing the corresponding opening against the user's eye protection, such as a pair of goggles, and against the breathing tube respectively.

The hood 100 may further comprise at least one secondary breathing opening 160, where the secondary breathing openings are configured to correspond to respirator cartridge locations when coupled with a respirator mask.

Each of the primary breathing opening 150 and the secondary breathing openings 160 are openings in the inelastic material and may be provided with filtration material 170. Such filtration material 170 may filter out debris from the air when the openings 150, 160 are not used for respirator cartridges or hoses. Typically, if a user is breathing through a respirator, all air breathed by the user will be filtered. However, any unfiltered air that enters the hood may still contact the user's skin, and any debris or dust may therefore be dangerous.

In order for a user to use the hood 100 with a respirator, the user will first insert the respirator into the hood without any cartridges or hoses fixed thereto. The user will then attach the hose to the respirator through the primary breathing opening 150 such that the gasket 155 is located in the connection between the hose and the respirator, thereby sealing the hood 100 against the respirator and the hose. Similarly, the user will then attach the respirator cartridges to the respirator through the secondary breathing openings 160 such that the gasket 155 is located in the connection between the cartridge and the respirator.

When the cartridges and the hose are fixed to the respirator, the filtration material 170 may remain in place in the corresponding openings 150, 160, such that the material provides an extra level of filtration. Alternatively, a user may remove the filtration material 170 in order to use the respirator cartridge with the hood 100. In such an embodiment, the filtration material 170 may be temporarily removable or it may be permanently fixed, such that a user cuts the material out of the hood 100 in order to use the hood with respirator cartridges. In some embodiments, the openings 150, 160 are filled with non-permeable materials such that a user removes the non-permeable materials if the hood 100 is to be used with respirator cartridges or hoses at each of those locations.

In this way, a user would typically fix a respirator to the interior of the hood 100 prior to use, and in order to put the hood on, the user would then fix the respirator to their face and then close the hood around their head.

The hood 100 may further comprise an elastic band 180 at a base of the hood in order to provide a seal against a user's shoulders, neck, or other safety equipment the user might be wearing. In such an embodiment, the elastic band 180 may comprise an elastic material encased with a non-permeable material, such as non-woven nylon, so that the elastic band 180 as a whole is non-permeable.

The front face 110 of the hood 100 may be provided with a plurality of darts 190. Such darts 190 may draw a lower portion of the hood 100 towards the face of a user, such that the hood has a fitted profile. Such a fitted profile can prevent the hood 100 from inflating and thereby obstructing a user's view and preventing the user from looking downwards. Accordingly, the hood 100 has a larger circumference at a location of the primary breathing opening 150 than at a base of the hood, such as at the elastic band 180.

The rear face 120 may be provided with a zipper opening 200. Such a zipper opening may be a construction grade zipper, and may be lined with a fabric guard. Accordingly, the interior of the zipper opening 200 may be lined with a non-woven fabric guard to reduce skin irritation and prevent contamination from entering the hood 100 via the zipper tape and teeth. The zipper opening 200 may be provided with a non-locking zipper. This would allow users to easily grasp the zipper and quickly unzip the hood if necessary. Similarly, a large pull tab provided in conjunction with a non-locking zipper may ease the removal of the hood when the wearer has gloved hands.

Figure 4:
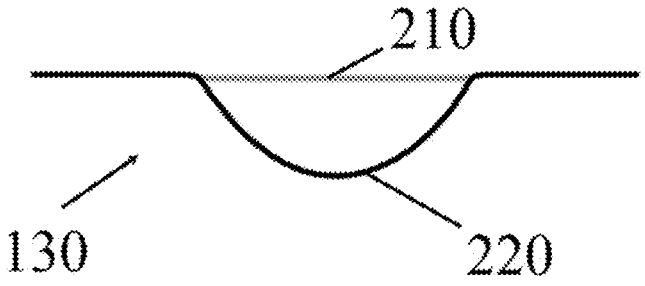
FIG. 4 is a section view of a stretch segment used in the hood of FIG. 1.

FIG. 4 is a section view of a stretch segment 130 used in the hood 100 of FIG. 1. As shown, each of the stretch segments 130 may form a gusset comprising a first layer 210 made of an elastic material and a second layer 220 made of an inelastic material. The inelastic material of the second layer 220 typically has a lower permeability than the first layer 210, such that the first layer provides a fabric made of an elastic material that allows for stretch but does not offer substantial protection to the user, such as a cotton poly knit material. The second layer 220 may then provide a guard material that does not stretch, but that protects the user from debris, such as a non-woven nylon material. In this way, the first layer 210 may improve the fit of the hood 100, and the second layer may protect the user from any contaminants that may breech the knit material.

In the embodiment shown and described, the first layer 210 of the stretch segments 130 may have a size in its unstretched state smaller than the size of the second layer 220. Accordingly, the second layer 220 may provide slack when the first layer 210 stretches.

The hood 100 described may be made of a wide variety of materials, so long as the materials selected protect the user as discussed herein. The primary fabric may be a water-resistant non-woven nylon material. The plastic gaskets 155 stretch so that they won't be rigid or crack under use, and to allow a tighter seal where necessary. Plastic is a thicker weight for durability, and the gasket is now larger to allow for circulation and a better fit.

Double top-lock stitching throughout prevents paint and debris from seeping through seams and holes in stitching.

Figure 5:
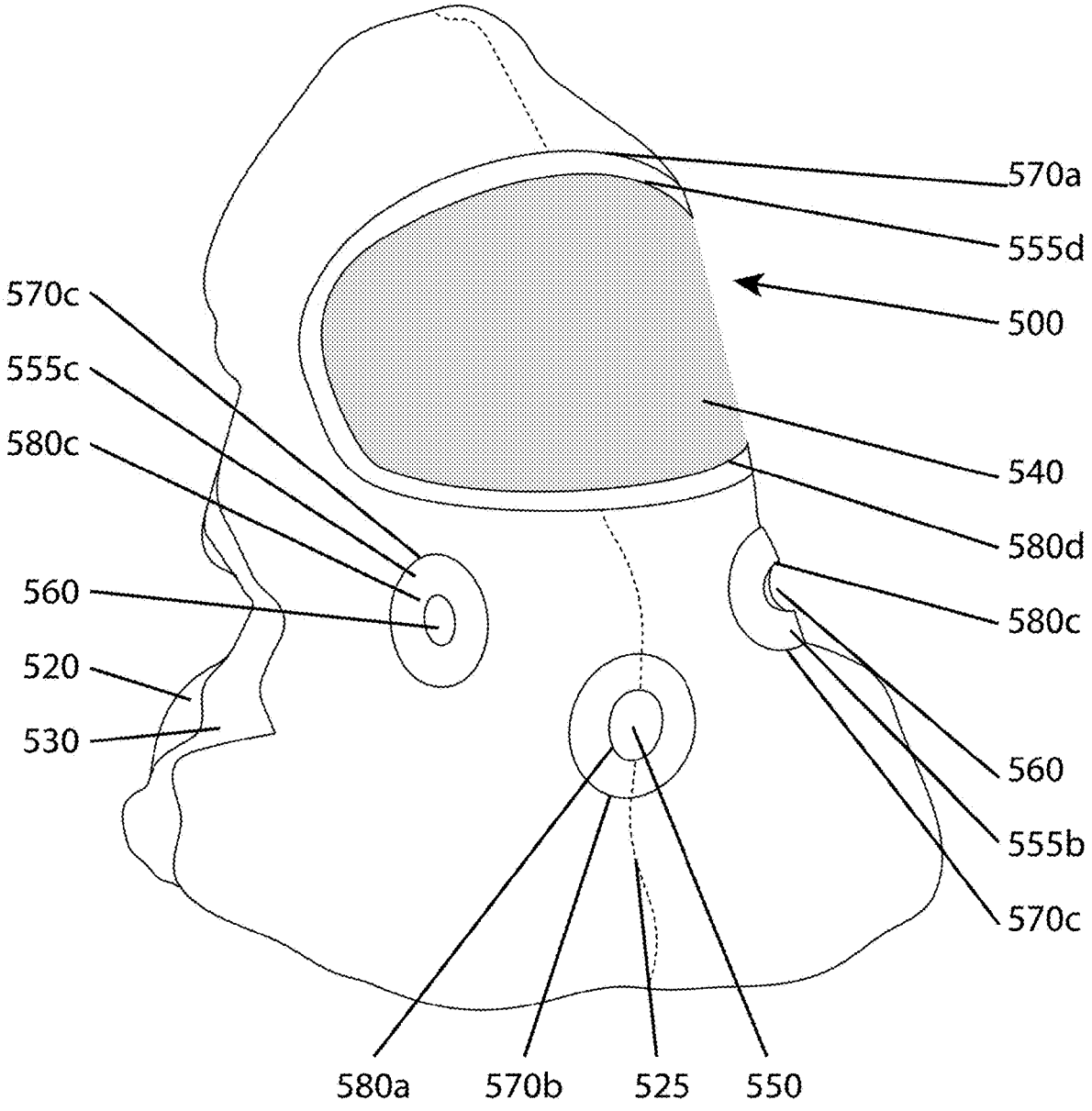
FIG. 5 is a front perspective view of a second embodiment of a hood in accordance with this disclosure.
Figure 6:
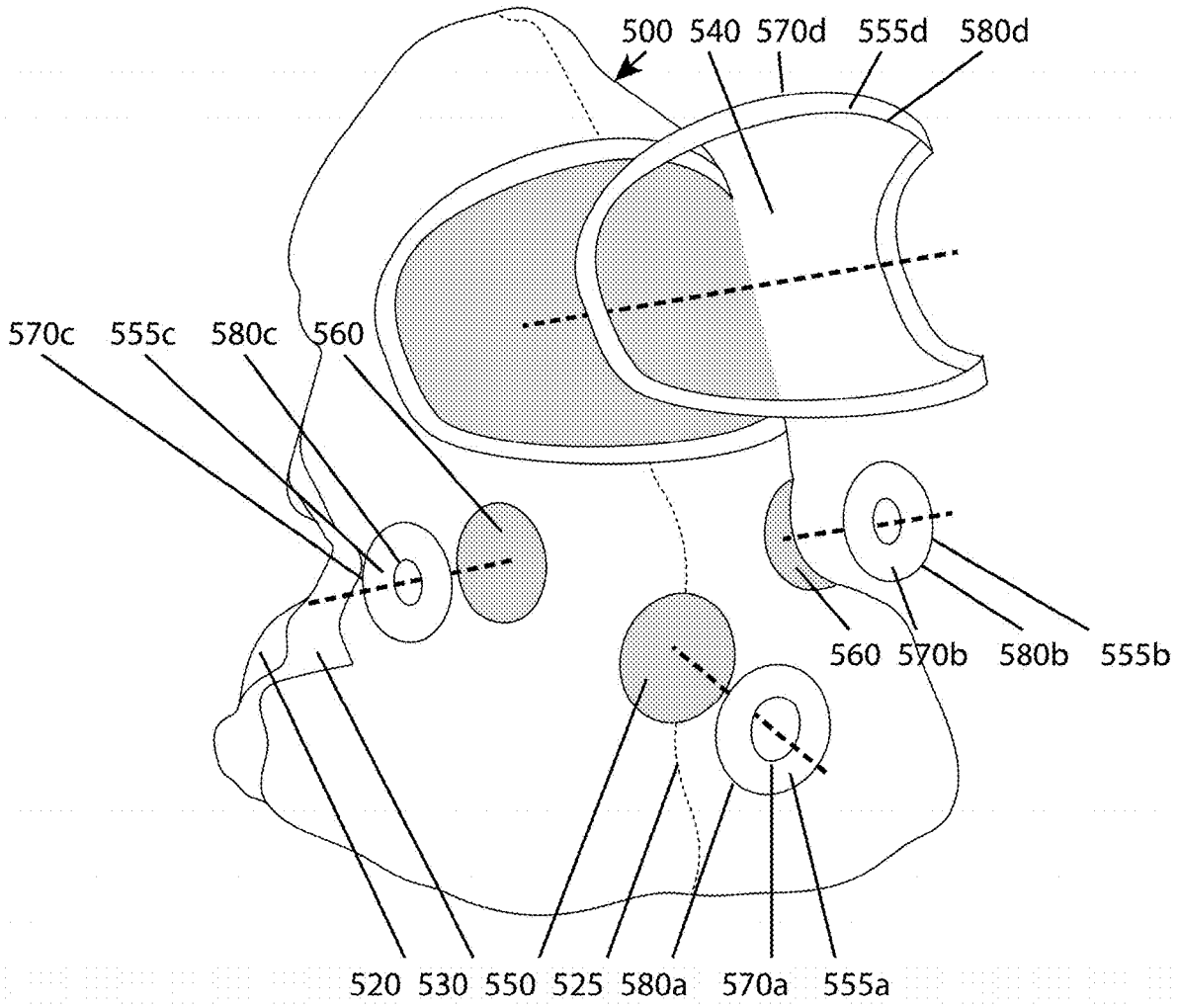
FIG. 6 is an exploded view of the hood of FIG. 5.
Figure 7:
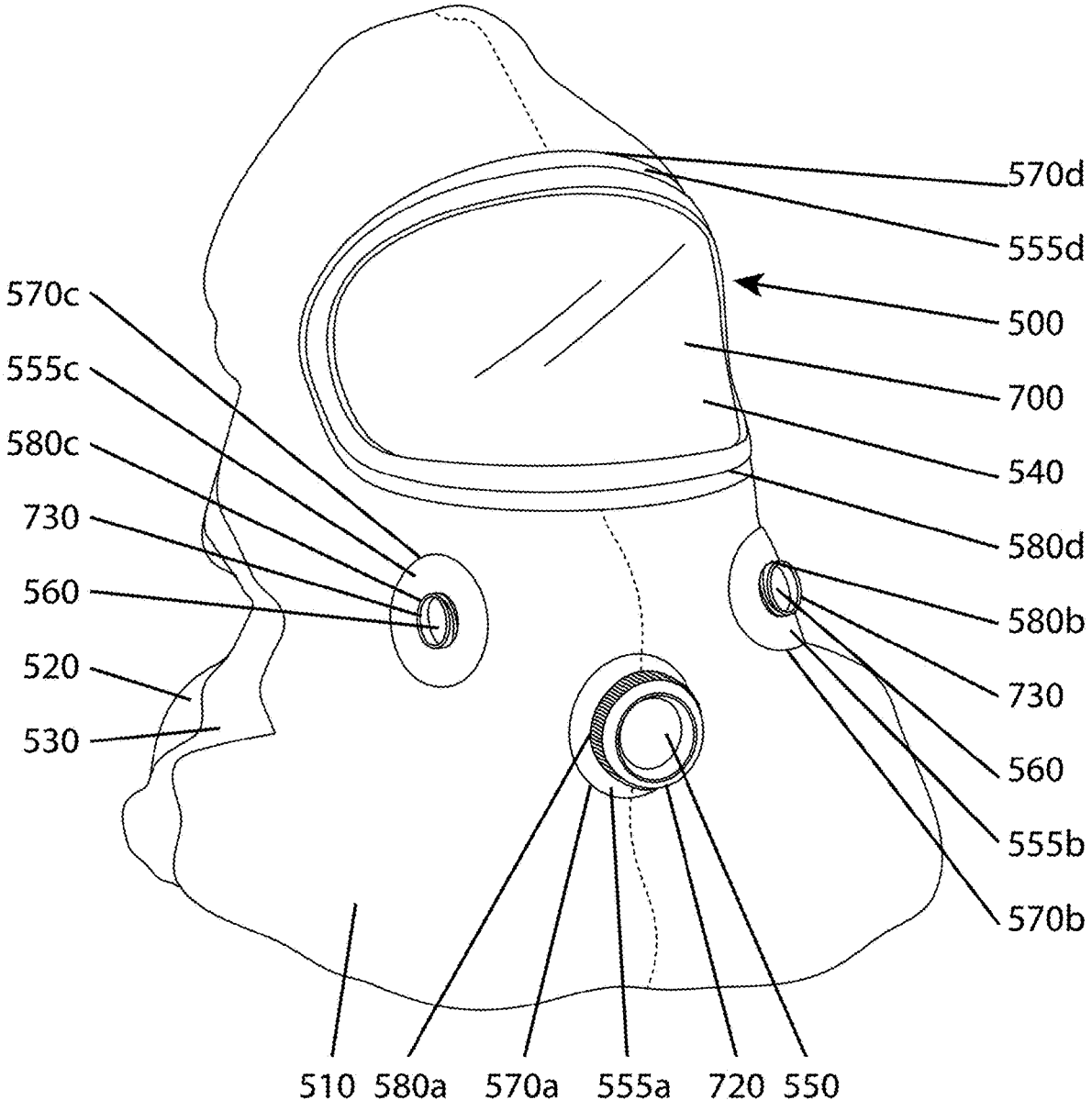
FIG. 7 shows the hood of FIG. 5 installed over a respirator mask.
Figure 8:
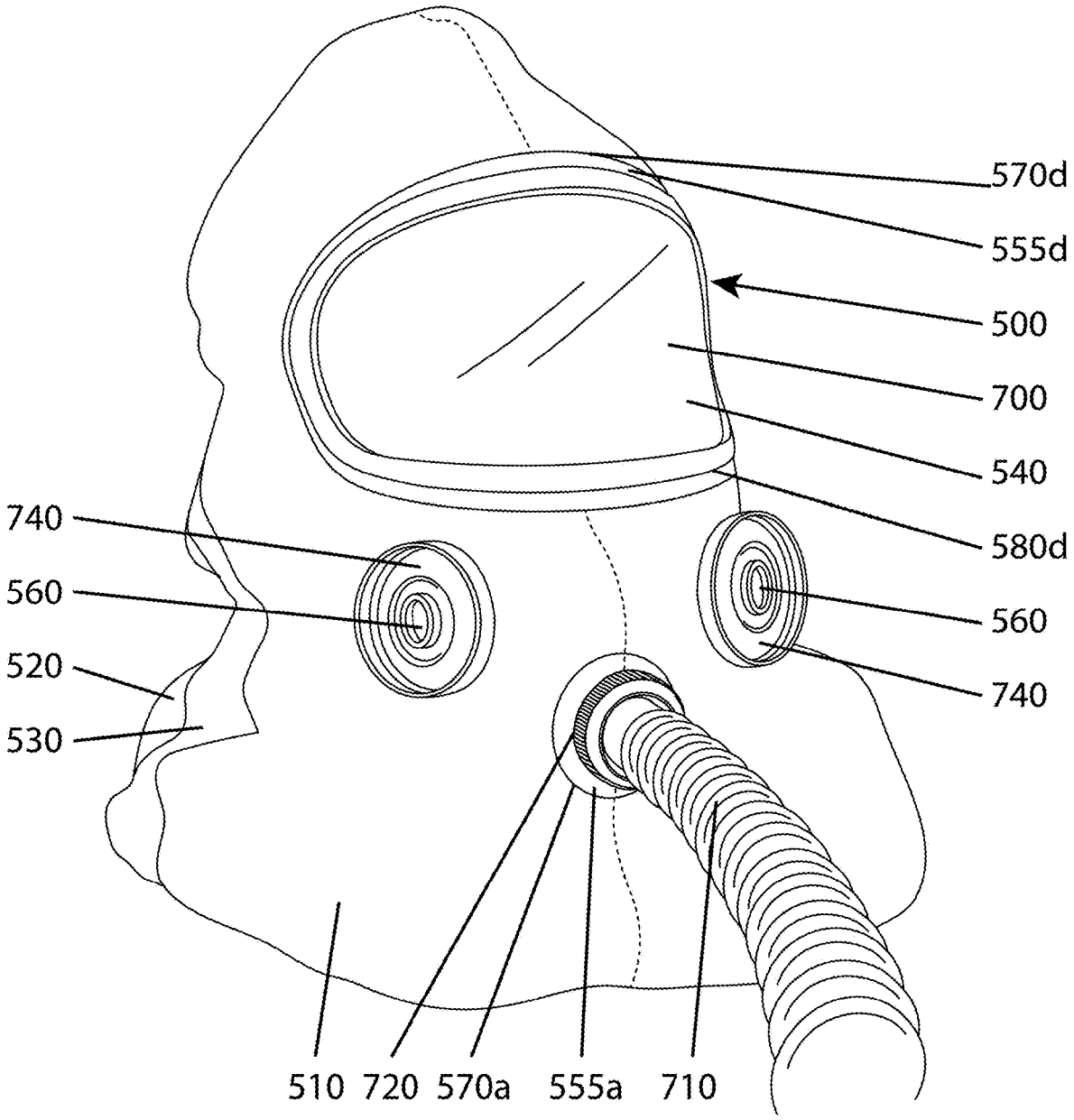
FIG. 8 shows the hood of FIG. 5 installed over a respirator mask with an air fed hose installed.
Figure 9:
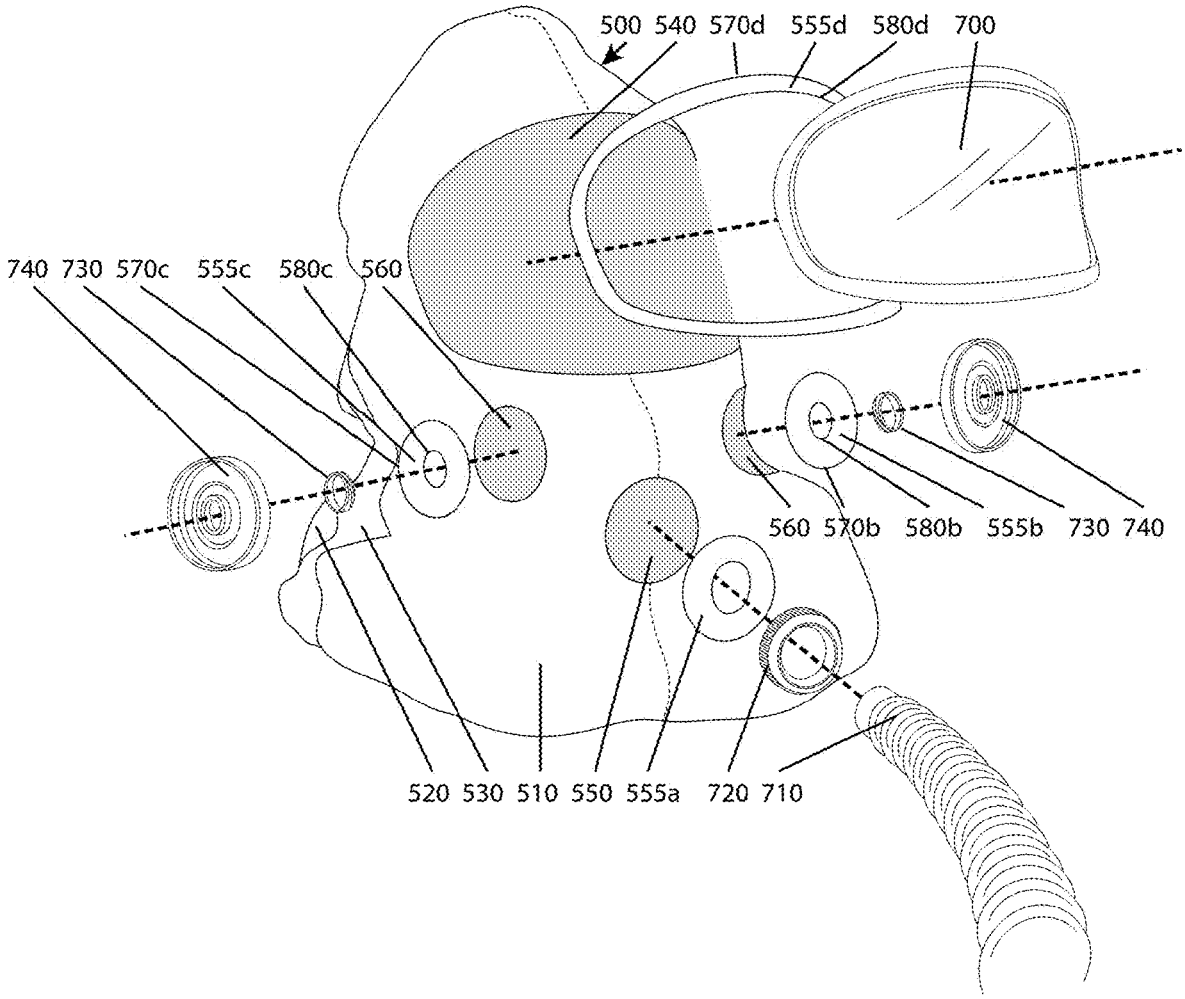
FIG. 9 shows an exploded view of the hood of FIG. 5 installed as shown in FIG. 8.

FIG. 5 is a front perspective view of a second embodiment of a hood 500 in accordance with this disclosure. FIG. 6 is an exploded view of the hood 500 of FIG. 5. FIG. 7 shows the hood 500 of FIG. 5 installed over a respirator mask. FIG. 8 shows the hood 500 of FIG. 5 installed over a respirator mask with an air fed hose installed. FIG. 9 shows an exploded view of the hood 500 of FIG. 5 installed as shown in FIG. 8.

The construction of the hood 500 of FIG. 5 is similar to that of FIG. 1. Accordingly, features not shown or discussed with respect to the embodiment of FIG. 5 may nonetheless be included such an embodiment.

Accordingly, as shown, the hood 500 comprises a front face 510 made of an inelastic material and a rear face 520 made of the same inelastic material. The front and rear faces 510, 520 may be linked with at least one stretch segment 530 connecting the inelastic faces. While the hood 500 is described in terms of a front face 510 and a rear face 520, it will be understood that this is simply a reference to a front portion and a rear portion of the hood. Accordingly, it will be understood that seams 525 of the hood 500 may not distinguish the front and rear faces and may instead run front to back, as in the embodiment shown. Accordingly, the front face 510 and rear face 520 may be portions of the same piece of material or several pieces of material and may be folded over a user's head to form the front and rear faces.

The front face 510 has a first opening 540 configured to correspond to a user's eye protection when the hood 500 is worn by a user. The front face 510 also has a primary breathing opening 550 configured to correspond to a respirator hose location when worn by a user.

The hood 500 is often used in conjunction with eye protection 700 and a respirator. Accordingly, when the respirator is worn by a user, the respirator may have a respirator tube 710, used as a breathing tube, extending away from the user. Such a tube 710 may then pass through the hood 500 at the primary breathing opening 550 of the front face 510. The respirator may further comprise a mating component 720 for locating within the primary breathing opening 550 and mating with the respirator tube 710.

The first opening 540 and the primary breathing opening 550 may each be provided with a gasket 555*a, d* for sealing the corresponding opening against the user's eye protection 700, such as a pair of goggles, and against the breathing tube 710 or the corresponding mating component 720 respectively.

A respirator worn by the user may further comprise respirator cartridges, which may be mated with the respirator by way of secondary mating components 730. Typically, such mating components 730 are located on either side of the breathing tube, and are positioned to support respirator cartridges at those locations. Accordingly, the hood 500 may further comprise at least one secondary breathing opening 560, where the secondary breathing openings are configured to correspond to respirator cartridge locations when coupled with the respirator mask.

During use, the secondary mating components 730 may mate with respirator cartridges directly or with respirator cartridge supports 740, thereby forming a tight seal with the corresponding gaskets 555*b, c.*

Each of the primary breathing opening 550 and the secondary breathing openings 560 are openings in the inelastic material, and are provided with a corresponding gasket 555*a, b, c*. In many embodiments, the first opening 540 is provided with a gasket 555*d* as well. The gasket 555*a, b, c, d* in each case is designed to seal with some component of a respirator system. The gasket 555*d* for the first opening 540 is designed to seal against the user's eye protection 700, the gasket 555*a* for the primary breathing opening 550 is designed to seal against the mating component 720 or the breathing tube 710, and the gaskets 555*b, c* for the secondary breathing openings 560 are designed to seal against the secondary mating components 730 for supporting the respirator cartridges.

Accordingly, each gasket 555*a, b, c, d* is somewhat elastic, and has an outer boundary 570*a, b, c, d* larger than a boundary of that component the gasket is designed to seal against and an inner boundary 580*a, b, c, d* smaller than the boundary of the component it is designed to seal against. Therefore, the first opening 540 has a gasket 555*d* having an outer boundary 570 larger than the rim of the eye protection 700 being used and an inner boundary 580 smaller than that size. Accordingly, when a user applies the eye protection 700 to the hood 500, the user stretches the corresponding gasket 555*d* over the rim of the eye protection 700.

Similarly, the gaskets 555*a, b, c* for the primary and secondary breathing openings 550, 560 are each shown mating with a corresponding mating component 720, 730. Accordingly, for each gasket 555*a, b, c*, the outer boundary, or circumference 570*a, b, c*, is larger than the circumference of the corresponding mating component 720, 730, and the inner boundary, or circumference 580*a, b, c* is smaller than the circumference of the corresponding mating component. In some embodiments, the primary breathing opening 550 may mate directly with the hose 710, in which case the outer circumference 570*a* of the gasket 555*a* is larger than the circumference of the hose 710 and the inner circumference 580*a* is smaller than that of the hose.

In order for a user to use the hood 500 with a respirator, the user will typically first insert the respirator into the hood without any cartridges or hoses fixed thereto. The user will then attach the hose 710 to the respirator through the primary breathing opening 550 such that the gasket 555*a* is located in a mating component 720 between the hose 710 and the respirator, thereby sealing the hood 500 against the respirator and the hose 710. Similarly, the user will then attach the respirator cartridges to the respirator through the secondary breathing openings 560 such that the gaskets 555*b, c* are stretched around the secondary mating components 730 at the connection between the corresponding cartridge and the respirator.

In this way, a user would typically fix a respirator to the interior of the hood 500 prior to use, and in order to put the hood on, the user would then fix the respirator to their face and then close the hood around their head. The user may similarly stretch the gasket 555*d* of the first opening 530 over the edge of the eye protection 700 either prior to or after closing the hood 500 over their head.

It will be understood that certain features are not shown in the hood 500 shown in FIGS. 5-9 for simplicity of presenting the features discussed. However, those features shown in the hood 100 of FIGS. 1-4 may be similarly implemented in the embodiment of FIG. 5. For example, while the back of the hood 500 is not shown, the embodiment may include the zipper opening 200 shown in FIG. 3. Similarly, while the elastic band 180 at the base of the hood 100 of FIG. 1 is not shown in the hood 500 of FIG. 5, it may be included along with an inelastic encasing material, as discussed above.

Figure 10:
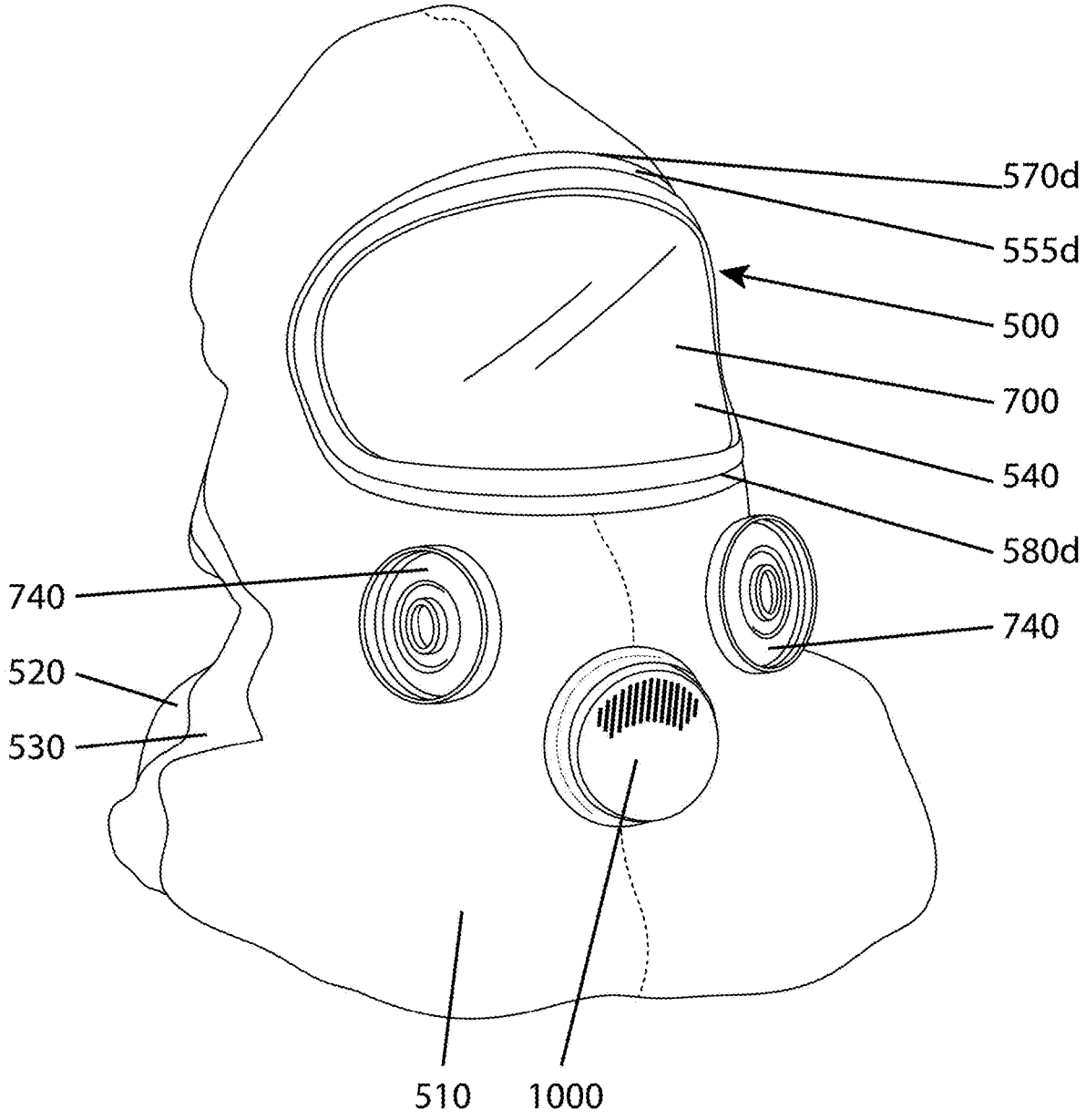
FIG. 10 shows the hood of FIG. 5 installed over a non-air fed respirator mask.

FIG. 10 shows the hood 500 of FIG. 5 installed over a non-air fed respirator mask. As shown, instead of the hose 710 shown in FIGS. 8 and 9, a primary respirator cartridge 1000 may be installed. Similarly, mating components and/or secondary respirator cartridge supports 740 for secondary respirator cartridges may be provided at the secondary breathing openings 560.

While the hood 500 shown and described may be used with a wide variety of respirators and respirator configurations, in each case, the gaskets 555*a, b, c, d* discussed above are used to seal the hood against whatever mating components are to be used. Accordingly, the hood 500 may be provided in different sizes with different sized gaskets 555*a, b, c, d* configured for use with different common respirators or respirator configurations.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A dust hood comprising:

a front face of an inelastic material;

a rear face of the inelastic material;

at least one stretch segment connecting the front face to the rear face;

the front face having a first opening configured to correspond to a location of a user's eye protection when worn by a user; and the front face having a primary breathing opening configured to correspond to a respirator hose or respirator air intake location when worn by a user, wherein the at least one stretch segment comprises a first layer comprising an elastic material and a second layer comprising an inelastic material having lower permeability than the elastic material, and wherein the size of the second layer of the stretch segment is larger than the size of the first layer of the stretch segment in an unstretched state.

2. The dust hood of claim 1, wherein the first opening and the primary breathing opening each comprise a gasket for sealing the first opening against a user's eye protection and the primary breathing opening against a user's respirator hose or respirator air intake.

3. The dust hood of claim 1 further comprising at least one secondary breathing opening configured to correspond to respirator cartridge locations when coupled with a respirator mask having a hose and respirator cartridges.

4. The dust hood of claim 3, wherein each of the primary breathing opening and the secondary breathing openings comprises a gasket for sealing the corresponding openings against the corresponding respirator hose and respirator cartridges respectively.

5. A dust hood comprising:

a front face of an inelastic material;

a rear face of the inelastic material;

at least one stretch segment connecting the front face to the rear face;

the front face having a first opening configured to correspond to a location of a user's eye protection when worn by a user; and the front face having a primary breathing opening configured to correspond to a respirator hose or respirator air intake location when worn by a user, the dust hood further comprising at least one secondary breathing opening configured to correspond to respirator cartridge locations when coupled with a respirator mask having a hose and respirator cartridges, wherein each of the primary breathing opening and the secondary breathing openings comprises a gasket for sealing the corresponding openings against the corresponding respirator hose and respirator cartridges respectively, and wherein each of the primary breathing opening and the secondary breathing openings are openings in the inelastic material and are provided with filtration material such that the openings filter debris when not in use with respirator cartridges.

6. The dust hood of claim 1 further comprising an elastic band at a base of the hood.

7. The dust hood of claim 6, wherein the elastic band is encased in the inelastic material.

8. The dust hood of claim 1, wherein the front face is provided with a plurality of darts such that the hood has a larger circumference at the location of the primary breathing opening than at a base of the hood.

9. The dust hood of claim 1, wherein the rear face comprises a zipper opening.

10. The dust hood of claim 9, wherein the zipper opening comprises a non-locking zipper.

11. A dust hood comprising:

a front face of an inelastic material;

a rear face of the inelastic material;

the front face having a first opening configured to correspond to a location of a user's eye protection when worn by a user; and the front face having a primary breathing opening configured to correspond to a respirator hose or respirator air intake location when worn by a user, wherein the primary breathing opening comprises an elastic gasket for sealing the primary breathing opening against a user's respirator, wherein the elastic gasket has an outer circumference and an inner boundary, wherein the inner boundary is smaller than the outer circumference, such that the inner boundary is stretchable in the direction of the outer boundary to admit a hose or respirator air intake larger than the inner boundary.

12. The dust hood of claim 11, further comprising at least one secondary breathing opening configured to correspond to respirator cartridge locations when coupled with a respirator mask having a hose and respirator cartridges, wherein the secondary breathing opening comprises a secondary elastic gasket for sealing the corresponding opening against a respirator dock location.

13. The dust hood of claim 11, further comprising at least one stretch segment connecting the front face to the rear face.

14. The dust hood of claim 13, wherein the at least one stretch segment comprises a first layer comprising an elastic material and a second layer comprising an inelastic material having a lower permeability than the elastic material, and wherein the size of the second layer of the stretch segment is larger than the size of the first layer of the stretch segment in an unstretched state.

15. The dust hood of claim 11, wherein the rear face comprises a zipper opening.

16. The dust hood of claim 15, wherein the zipper opening comprises a non-locking zipper.

17. The dust hood of claim 11 further comprising an elastic band at a base of the hood, and wherein the elastic band is incased with an inelastic material.

18. A dust hood system comprising:

a dust hood comprising:

a front face of an inelastic material;

a rear face of the inelastic material;

the front face having a first opening configured to correspond to a location of a user's eye protection when worn by a user; and the front face having a primary breathing opening configured to correspond to a respirator hose location when worn by a user, and a respirator comprising:

a respirator hose having a hose circumference, wherein the primary breathing opening comprises an elastic gasket for sealing the primary breathing opening against the respirator tube, wherein the elastic gasket has an outer circumference larger than the hose circumference and an inner boundary smaller than the hose circumference.

19. The dust hood system of claim 18, wherein the respirator further comprises at least one respirator docking location having a dock circumference, and wherein the dust hood further comprises at least one secondary breathing opening configured to correspond to the location of the respirator docking location, wherein the secondary opening comprises a secondary elastic gasket for sealing the corresponding opening against the respirator docking location, wherein the secondary elastic gasket has an outer circumference larger than the dock circumference and an inner boundary smaller than the dock circumference.

20. The dust hood of claim 11, wherein the elastic gasket lies substantially in a surface defined by the front face.

* * * * *